United States Patent [19]

Diggs

[11] 4,010,560

[45] Mar. 8, 1977

[54] DEEP SEA MINING APPARATUS AND METHOD

[76] Inventor: Richard E. Diggs, 12 A Road, Carthage, Mo. 64836

[22] Filed: May 14, 1975

[21] Appl. No.: 577,343

[52] U.S. Cl. ..... 37/54; 37/DIG. 8; 299/9

[51] Int. Cl.[2] ..... E02F 7/00

[58] Field of Search ..... 37/54, 69, DIG. 1, DIG. 8, 37/71; 299/8, 9; 181/101, 123, 125, 139, 140, 141, 143

[56] References Cited

UNITED STATES PATENTS

| | | | |
|---|---|---|---|
| 3,314,174 | 4/1967 | Haggard | 37/54 |
| 3,365,823 | 1/1968 | Vogt | 299/8 X |
| 3,522,670 | 8/1970 | Flipse et al. | 37/DIG. 8 |
| 3,672,725 | 6/1972 | Johnson | 37/DIG. 8 X |
| 3,675,348 | 7/1972 | Dawe, Jr. | 37/69 |
| 3,748,248 | 7/1973 | Wanzenberg et al. | 37/DIG. 8 |
| 3,866,160 | 2/1975 | Brasier | 181/125 X |
| 3,908,290 | 9/1975 | Condolios | 37/DIG. 8 |

FOREIGN PATENTS OR APPLICATIONS

| | | | |
|---|---|---|---|
| 267,775 | 3/1927 | United Kingdom | 37/69 |

OTHER PUBLICATIONS

Ellicott Introduces New "Super-Dragon" Dredge, Dredging Progress, vol. X, No. 1, 2nd Quarter, 1967.

*Primary Examiner*—E. H. Eickholt
*Attorney, Agent, or Firm*—Shoemaker and Mattare, Ltd.

[57] ABSTRACT

A deep sea mining apparatus and method for mining mineral nodules from the ocean floor, comprises at least one surface ship and preferably a plurality of nodule harvesting or mining machines supported from the surface ship and resting on the ocean floor for movement along the ocean floor and including nodule gathering devices to gather the mineral nodules as the machine passes over the ocean floor. The nodule harvesting machines include separable, nodule-containing crates which, when full, are lifted to the surface where they are recovered by a surface ship. The crates are emptied of their contents and subsequently returned to the machines on the ocean floor to be refilled. The placement and guidance of the harvesting machines on the ocean floor is controlled by sonar devices and television cameras and the like.

16 Claims, 14 Drawing Figures

FIG. 5.
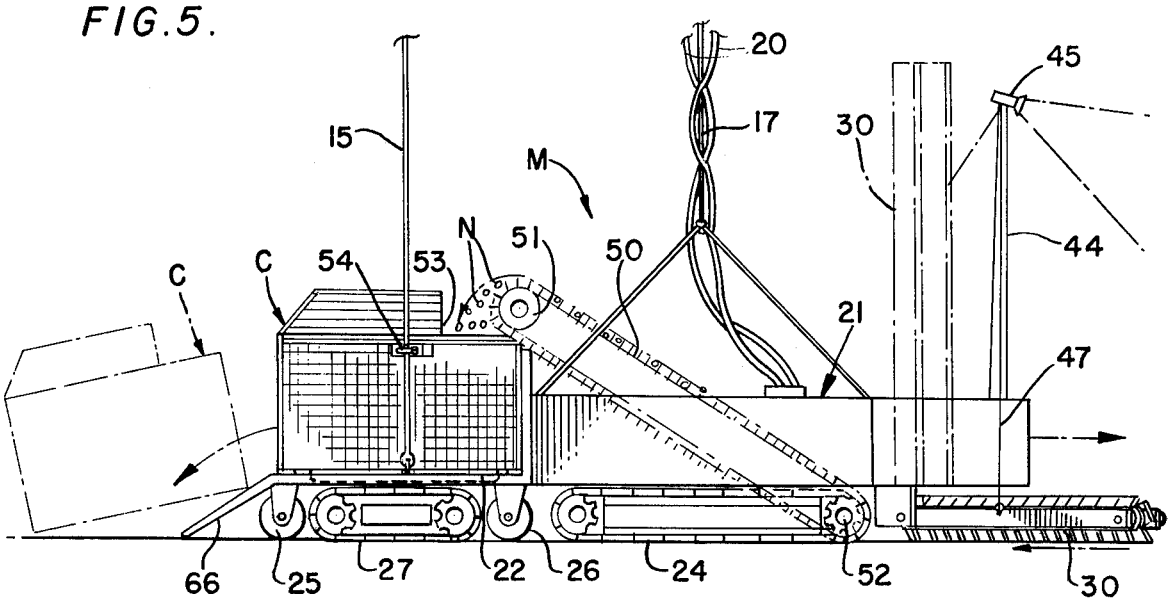
FIG. 12.
FIG. 6.
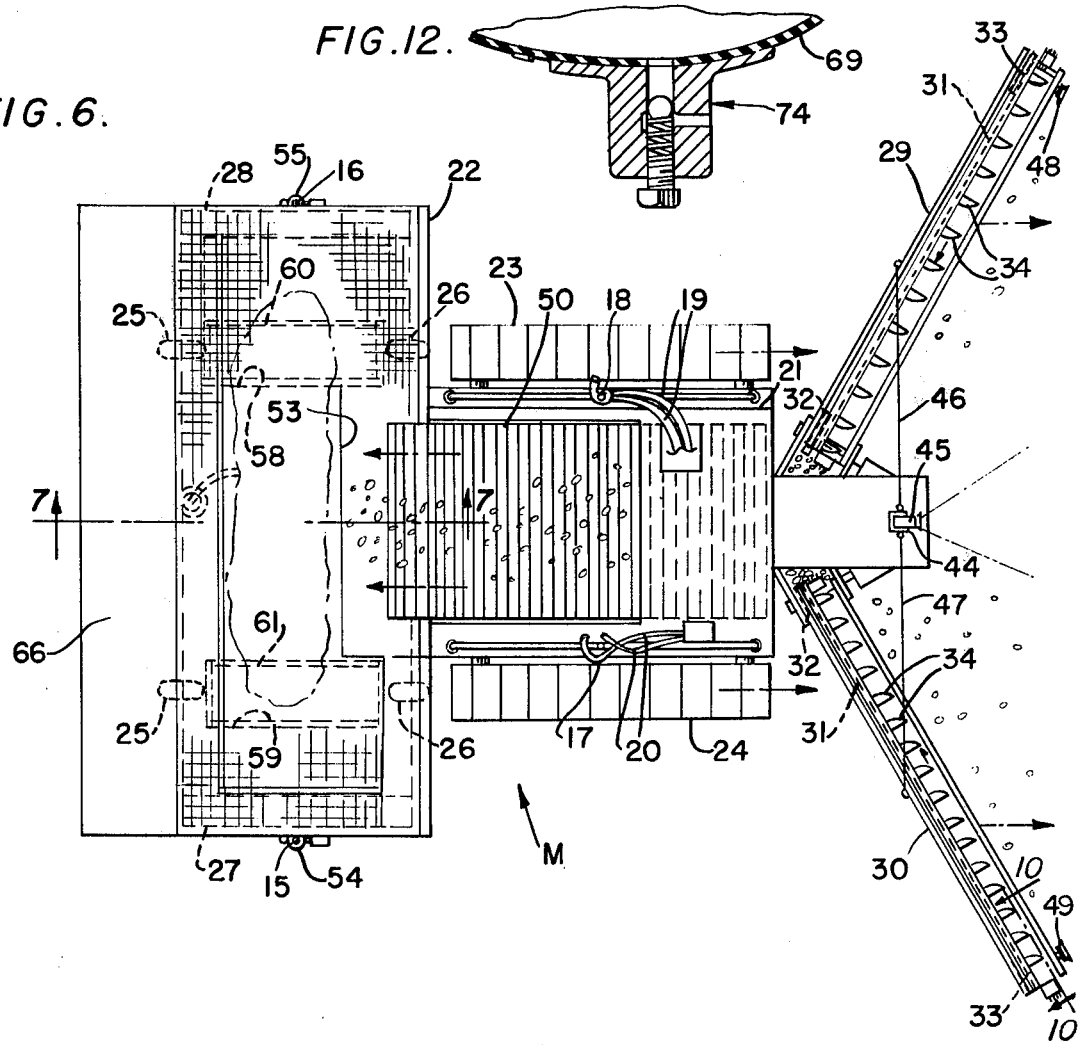

FIG. 7a.
FIG. 7.
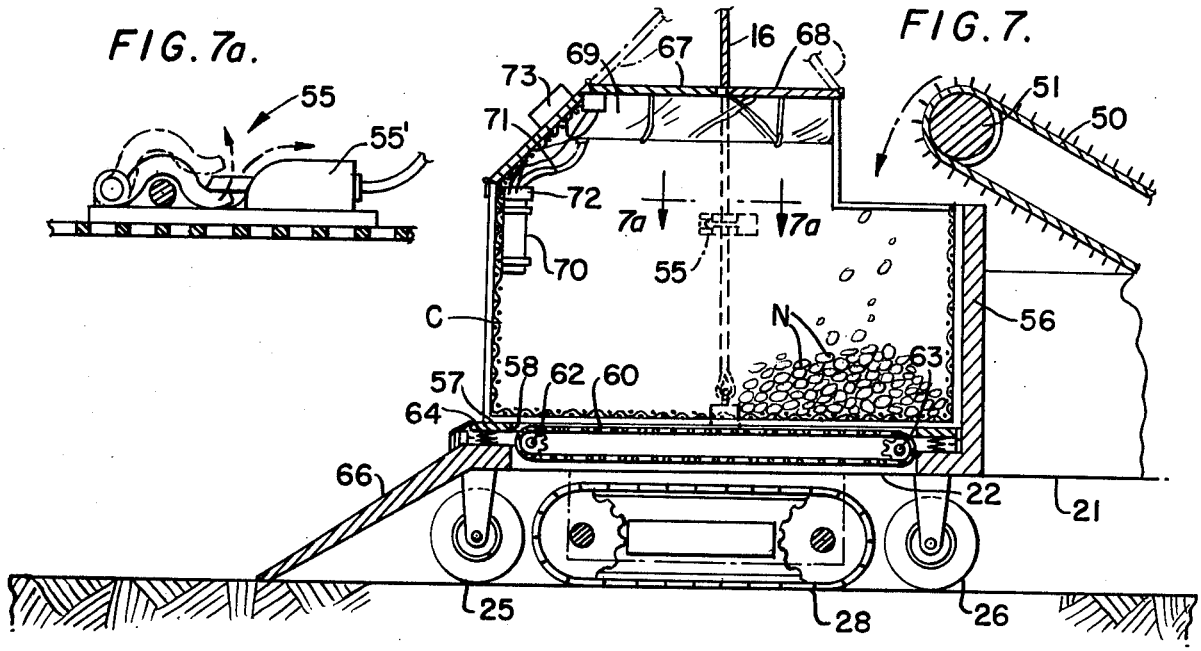
FIG. 8.
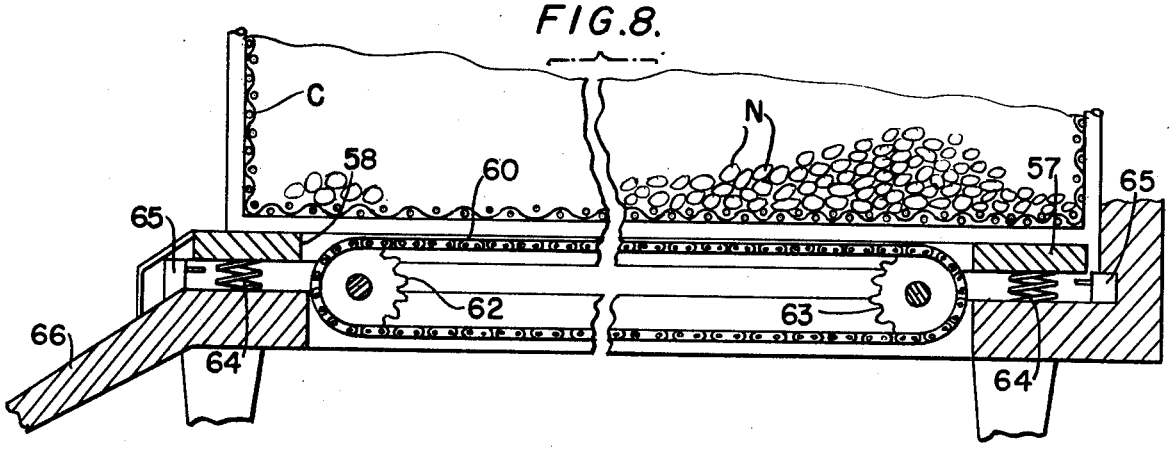
FIG. 9.
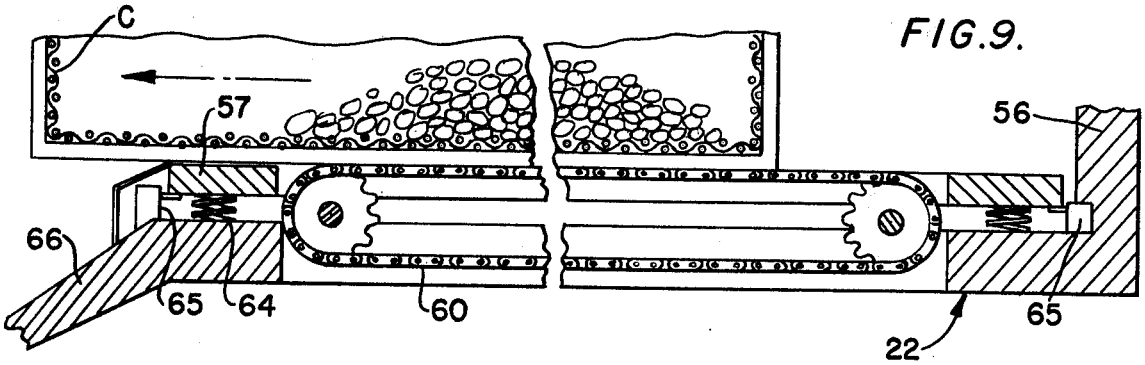

DEEP SEA MINING APPARATUS AND METHOD

BACKGROUND OF THE INVENTION

This invention relates generally to deep sea mining apparatus and to a method of mining or harvesting the great abundance of mineral nodules present on the ocean floor in many parts of the world.

More particularly, the present invention relates to an apparatus and method for mining mineral nodules from the ocean floor at great depths of from about 3,000 to 15,000 feet, for example, and in particular, includes at least one surface ship from which a plurality of nodule mining or harvesting machines are supported and controlled, said machines being self-propelled and resting on the ocean floor for movement therealong, and including nodule gathering means for gathering the nodules from the floor and placing them in a nodule holding crate, which is separable from the machine when full, and which is provided with lift means for lifting the crate to the surface for recovery of the nodules.

It has been known for many years that vast amounts of minerals are present in the oceans of the world, and in particular, that mineral-rich nodules are present on the ocean floor in many parts of the world. However, such nodules frequently are found only at great depths as, for example, from 3,000 to 15,000 feet below the surface of the ocean, and the technological problems of mining or harvesting the nodules has thus far been practically insurmountable. For example, at a depth of 15,000 feet, nearly three miles separates the nodules from the surface of the ocean, and the pressure is greater than 6,000 psi. Additionally, in the ocean there is the problem of surface wind and wave action and the movement of currents below the surface. Therefore, it is readily apparent that conventional mining techniques and apparatus are not satisfactory for use in the ocean to recover the nodules from such great depths.

Heretofore, various attempts have been made in the prior art to devise means and methods for mining the nodules from the ocean floor at depths ranging from 3,000 feet to 15,000 feet below the surface, and such prior art apparatus has included suction devices and drag scoops and the like, but these efforts have not been successful due to the great difficulty in controlling or accurately guiding them at the depths encountered, and because of the tremendous power requirements necessary to lift the nodules from the ocean floor to the surface.

Thus, some means and method is desirable in order to facilitate economic mining of the nodules from the ocean floor at great depth, and which effectively overcomes the problems encountered in the prior art.

OBJECTS OF THE INVENTION

Therefore, it is an object of this invention to provide an apparatus for mining or harvesting mineral nodules from the ocean floor at great depths beneath the surface of the ocean.

A more specific object of the invention is to provide an apparatus which includes a self-propelled mining machine on the ocean floor, supported and controlled from a support ship floating in the body of water, and wherein sonar guidance means is provided to obtain accurate guidance of the mining machine on the floor to thus most efficiently and effectively harvest the nodules from a given area of the floor.

Another object of the invention is to provide an apparatus for gathering material from the floor of a body of water, wherein very little power is required to gather the material and bring it to the surface of the body of water for recovery thereof.

A still further object of the invention is to provide a deep sea mining apparatus and method wherein at least one mining machine is supported on the floor of the body of water for movement therealong to gather mineral nodules and the like from the floor of the body of water, and wherein the nodules and the like are collected in a crate carried by the machine and said crate is separable from the machine and includes lift means for lifting the crate and nodules to the surface of the body of water for recovery of the nodules and the like.

Another object of the invention is to provide an apparatus and method for deep sea mining or harvesting of mineral nodules from the floor of the ocean, wherein the apparatus and method is accurately and economically controlled, and wherein significantly greater amounts of mineral nodules may be mined than possible with prior art apparatus and method.

BRIEF DESCRIPTION OF THE DRAWINGS

FIG. 5 is an enlarged view in elevation of one of the mining machines according to the invention.

FIG. 6 is a plan view of the machine of FIG. 5.

FIG. 7 is an enlarged, fragmentary, sectional view of a portion of the machine of FIG. 5, showing the nodule collecting crate and its relationship to the machine.

FIG. *7a* is a greatly enlarged view in section taken along line *7a—7a* of FIG. 7, showing one of the detent means for connecting the crate to the support cables for the machine.

FIG. 8 is a greatly enlarged, fragmentary view in elevation, with portions broken away, of the nodule collecting crate and its support on the machine.

FIG. 9 is a view similar to FIG. 8 showing a nodule filled crate being separated from the machine.

Figure 10:
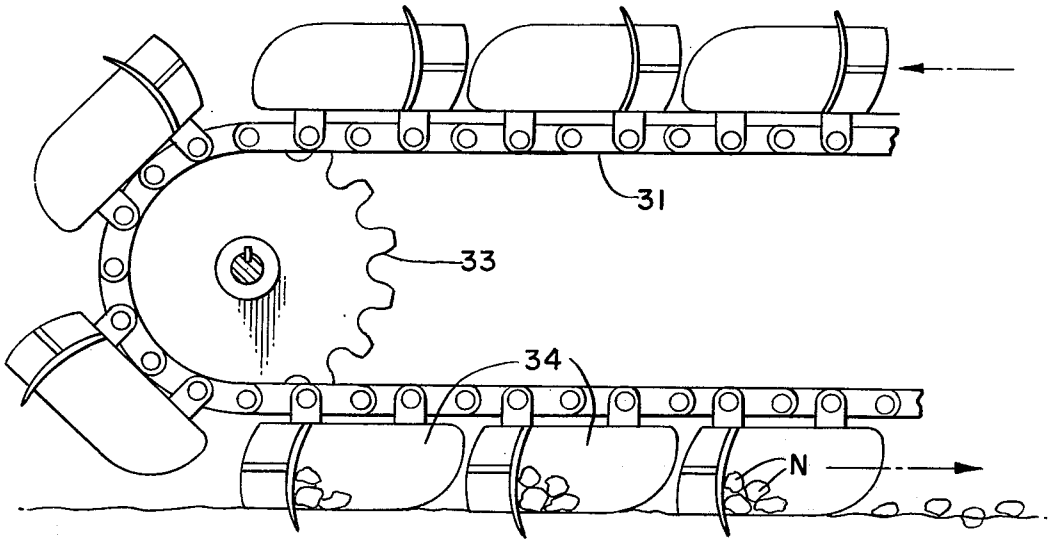

FIG. 10 is a greatly enlarged, fragmentary view in elevation of part of the nodule gathering means of the mining machine.

Figure 11:
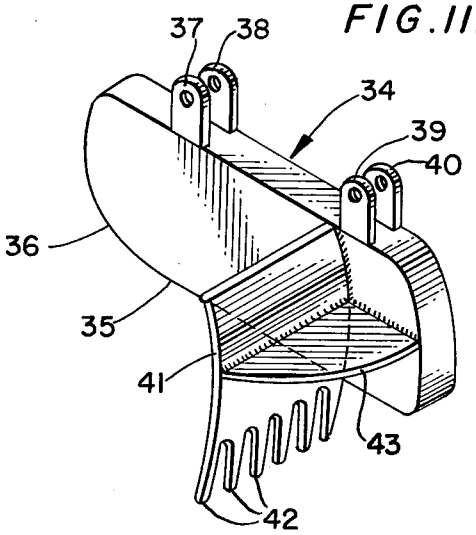

FIG. 11 is an enlarged, perspective view of one of the nodule gathering drag scoops of the nodule gathering means of FIG. 10.

Figure 1:
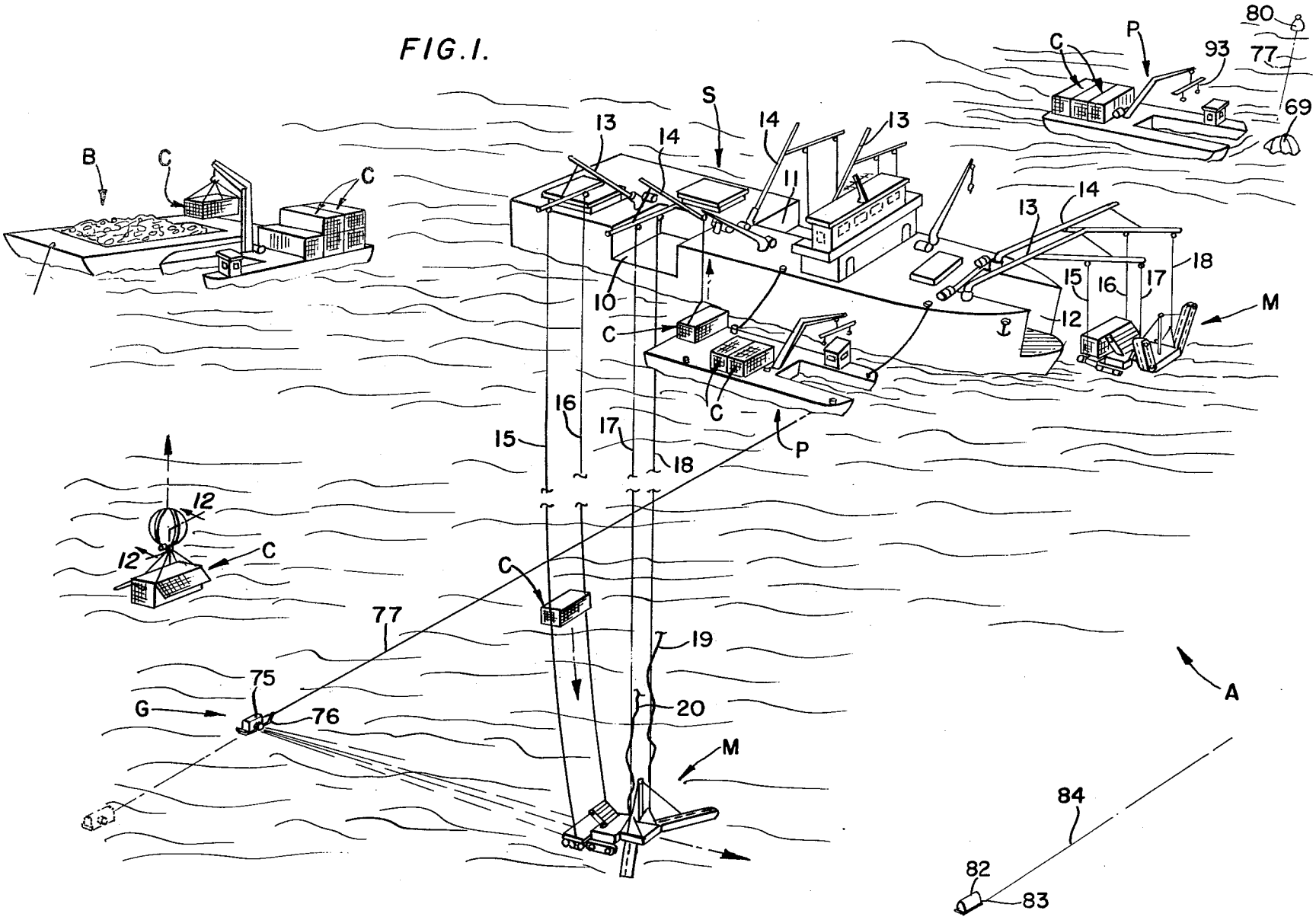
FIG. 1 is a somewhat schematic, perspective view of the apparatus used in accordance with the invention.
Figure 2:
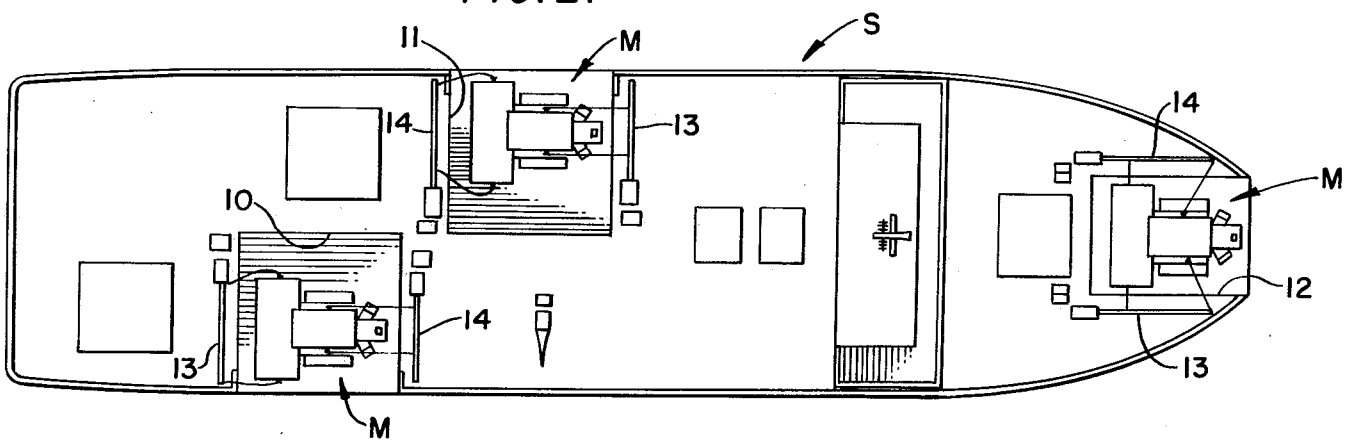
FIG. 2 is a somewhat schematic plan view of the support ship used with the apparatus of the invention.

FIG. 12 is a greatly enlarged, fragmentary view in section of the pressure relief valve on the crate lifting means and is taken along line 12—12 in FIG. 1.

Figure 13:
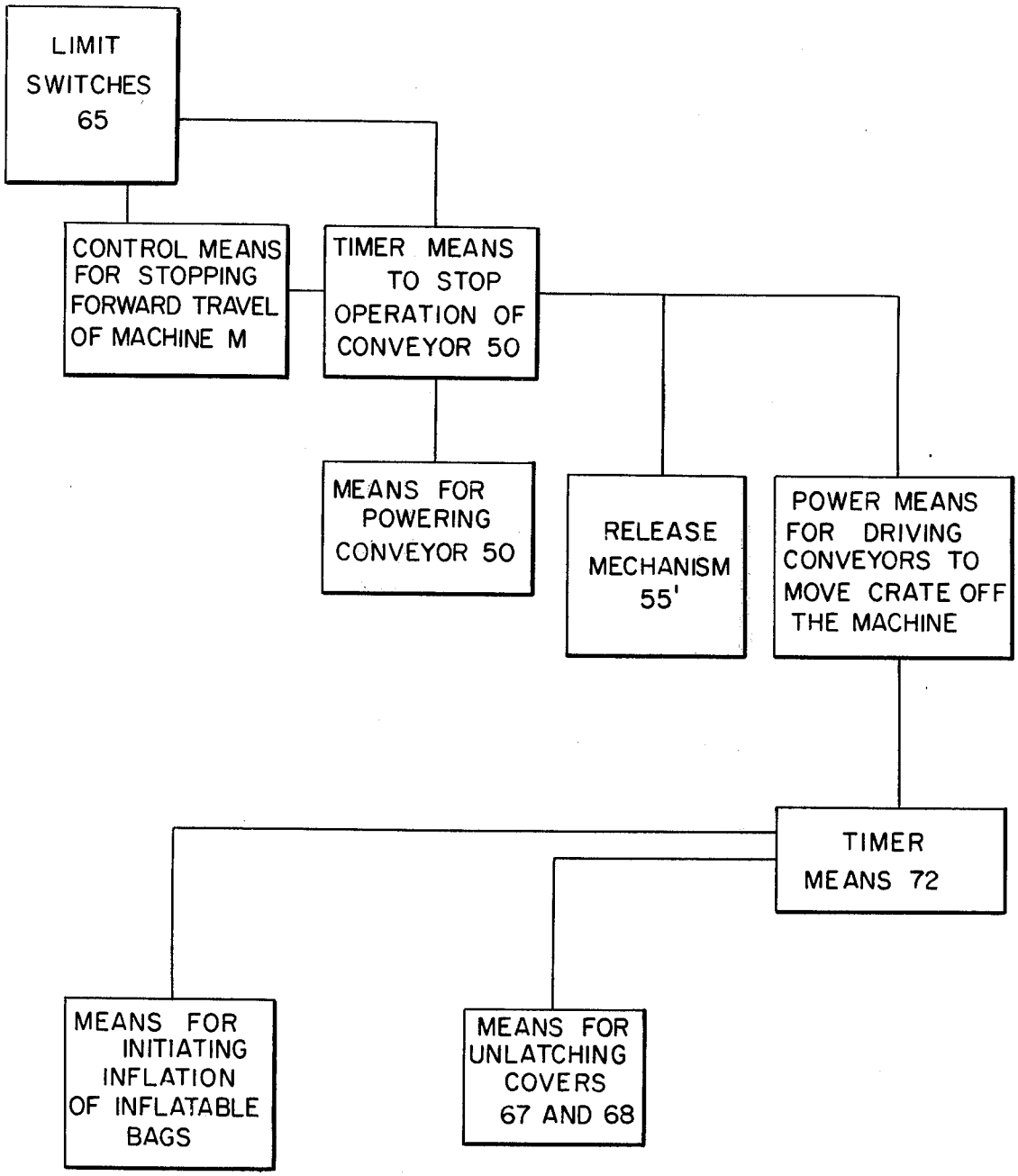

FIG. 13 is a block diagram of a control system in accordance with the teaching of the present invention.

DETAILED DESCRIPTION OF THE INVENTION

In the drawings, wherein like reference numerals indicate like parts throughout the several views, the deep sea mining apparatus is indicated generally at A and includes a support ship S, shown here as floating on the surface of the body of water, a plurality of mining machines M supported and controlled from the support ship S, at least one barge B for collecting and storing mineral nodules brought from the floor of the body of water, and a plurality of pickup or recovery boats P which retrieve the nodule containing crates C as they float to the surface and empty the contents thereof into the barge or barges B prior to returning the crates C to the support ship S for return of the empty crates C to the mining machines M to be refilled with nodules.

Part of a unique guidance system for the mining machines M is indicated generally at G in FIG. 1.

In a preferred embodiment of the invention, the support ship S would include three dry berths 10, 11 and 12 at the starboard and port sides and bow of the ship, respectively, in which the mining machines M could be placed for servicing or storage when not in use. Each of the berths is serviced by a pair of overhead tilt cranes 13 and 14. A pair of cables 15, 16 and 17, 18 are connected with and controlled from the cranes 13 and 14, respectively, and the cables 15, 16, 17 and 18 are connected with the mining machine M for supporting and controlling the mining machine. The pair of cables 15 and 16 are connected with the machine M at opposite sides thereof near the rear portion of the machine for lowering and guiding the empty crates C to the machine M, and the other cables 17 and 18 are connected with the main portion of the machine near the front thereof for supporting and controlling the machine M. Power supply cables 19 are connected with the cable 18 at one side of the machine for supplying power to the machine, and television and control cables 20 are carried by the other cable 17 at the other side of the machine M for transmitting control signals to and from the machine and for transmitting television signals from the machine to the support ship S.

Each machine comprises a main frame or body portion 21 having a rearwardly extending, crate supporting platform 22 and the machine is supported on and propelled by a pair of endless tracks 23 and 24 at opposite sides of the main body portion and by a combination of wheels 25 and 26 and endless tracks 27 and 28 beneath the platform 22. Suitable motive power means, such as an electric motor or the like (not shown), is carried in the main body portion 21 for driving the tracks 23, 24, 27 and 28 to propel the machine forwardly along the floor of the body of water, and power for the motor is supplied through cable or cables 19 extending from the support ship S. A pair of outwardly and forwardly deployed sweep arms 29 and 30 are carried by the machine at the forward end of main body portion 21 thereof, and each of the sweep arms supports a drag chain 31 disposed over a drive sprocket 32 at the inner end of the arm and an idler sprocket 33 at the outer end of the arm. A plurality of substantially identical scoops or drag buckets 34 are secured to and carried by each of the drag chains 31, and as seen best in FIG. 11, each of the drag scoops 34 includes a skid shoe 35 having a rounded nose portion 36 and a pair of upstanding lugs 37, 38 and 39, 40 at opposite ends thereof, respectively, whereby the skid 35 is connected to the chain 31. A curved scraper blade 41 is welded or otherwise suitably secured along one edge thereof to one side face of the skid shoe 35, and a plurality of downwardly projecting teeth 42 are on the lower end of the scraper blade. A reinforcing bracket or plate 43 is welded behind the blade 41 and to the side of skid shoe 35 to rigidify and stengthen the drag scoop structure.

In use, as seen in FIG. 10, the drag chain is driven or caused to be moved around the sprockets, pulling the drag scoops 34 along the floor of the body of water, and the skid shoe 35 prevents the scraper or teeth from digging too far into the floor, and yet enables the drag scoop to closely follow the contour of the floor. The spaced teeth 42 enable small particles, such as silt, mud, sand and the like, to be sorted out and left on the floor, and yet the blade 41 pushes the nodules N along the sweep arm toward the center of the path of movement of the machine M, forming a windrow of nodules.

An upstanding mast 44 is carried by the machine at the forward end, and a combination searchlight and television camera 45 is supported on the upper end thereof for illuminating the path of travel of the machine and giving a visual indication of the condition of the floor of the body of water. A pair of cables 46 and 47 are connected with the mast near the upper end thereof and with the arms 29 and 30 between the ends thereof to support the arms in an upright position, as indicated in phantom line in FIG. 5, when the arms are not in use. A pair of fixed television cameras 48 and 49 are carried by the sweep arms 29 and 30 at their outer ends thereof.

An endless conveyor or windrow elevator 50 is disposed about a pair of sprockets or pulleys 51 and 52 in the center part of the machine for conveying the nodules N from the windrow upwardly to an opening 53 in the upper surface of the crate C to fill the crate with the nodules gathered and swept inwardly by the drag buckets or scoops 34 carried by the drag chain 31 on the sweep arms 29 and 30.

The crates C each have a cable clamping device 54 and 55 at the opposite sides thereof, respectively, for releasable engagement with the crate lowering and guiding cables 15 and 16, whereby the crates may be lowered and guided at a controlled rate of descent to the platform 22.

As seen in FIGS. 7–9, and 13 the platform 22 has a front wall 56 and a yieldably supported crate supporting pallet or member 57 having a pair of parallel, spaced apart slots or openings 58 and 59 therethrough, and in which a pair of endless chains or belts and the like 60 and 61 are respectively disposed. The belts 60 and 61 are disposed about a pair of reversible sprockets or pulleys and the like 62 and 63 connected with a suitable source of power which is reversible, whereby the belts or chains and the like 60 and 61 may be driven in opposite directions so that the machine can be turned in any suitable direction. The pallet or member 57 is resiliently supported on any suitable means, such as springs 64 or the like, and limit switches 65 or other suitable means are disposed beneath the pallet 57, such that when the crate C is filled with nodules N to a predetermined level, the weight of the nodules causes the pallet 57 to move downwardly against the bias of the springs or the like 64 to engage the microswitches or other means 65 and operate suitable control means (shown schematically) to stop forward travel of the machine M. A suitable timer means (shown schematically) also connected with the microswitches and with the motive power means for the machine stops operation of the conveyor 50 a suitable predetermined time, such as 30 seconds or the like, after cessation of forward travel of the machine M. Immediately thereafter, the timer means also energizes a release mechanism, such as 55′ in FIG. 7*a*, and; associated with the cable clamping devices 54 and 55 to release the crate C from the cables 15 and 16, and the power means connected with the sprockets 62 and 63, or with one of the sprockets 62 and 63, as desired, is then operated in a first direction to move the endless belts or chains or the like 60 and 61 to move the filled crate C to the rear of the machine and onto the floor of the body of water, as indicated in phantom line in FIG. 5. A suitably inclined ramp 66 is provided at the rear of platform 22 for easing the filled crate to the floor of the body of water.

The crate C also has a hinged cover comprising a pair of hinged lids or cover portions 67 and 68 at the top of the crate, and an inflatable, crate lifing bag or balloon 69 is carried by the crate beneath the hinged covers 67 and 68, and a suitable source of air or other gaseous pressure 70 is secured in the crate and is connected with the lifting bag or balloon 69 by means of a conduit 71. A suitable timer means 72 is operatively connected with the covers 67 and 68 to open the covers when the crate has been conveyed off of the platform 22, and also to activate the cartridge or source of pressure 70 to inflate the lift bag 69. The cartridge or pressure source 70 may comprise any suitable means, such as a solid propellant or the like, capable of generating sufficient gaseous pressure to inflate the bag at the pressures encountered at the extreme depths at which the machine is intended to operate. Each crate C also carries a suitable sonar device 73, which emits a predetermined code representative of each crate, whereby the location of each crate and its identity may be readily ascertained from the surface to facilitate recovery of the crates.

As seen in FIG. 12, the lifting means or lift bags 69 for the crates are provided with a suitable pressure relief means or valve 74 set to maintain a pressure differential between the inside of the bag and the surrounding body of water of 20 psi, for example, to prevent rupture of the bag as it nears the surface and the pressure of the surrounding body of water becomes less.

Figure 3:
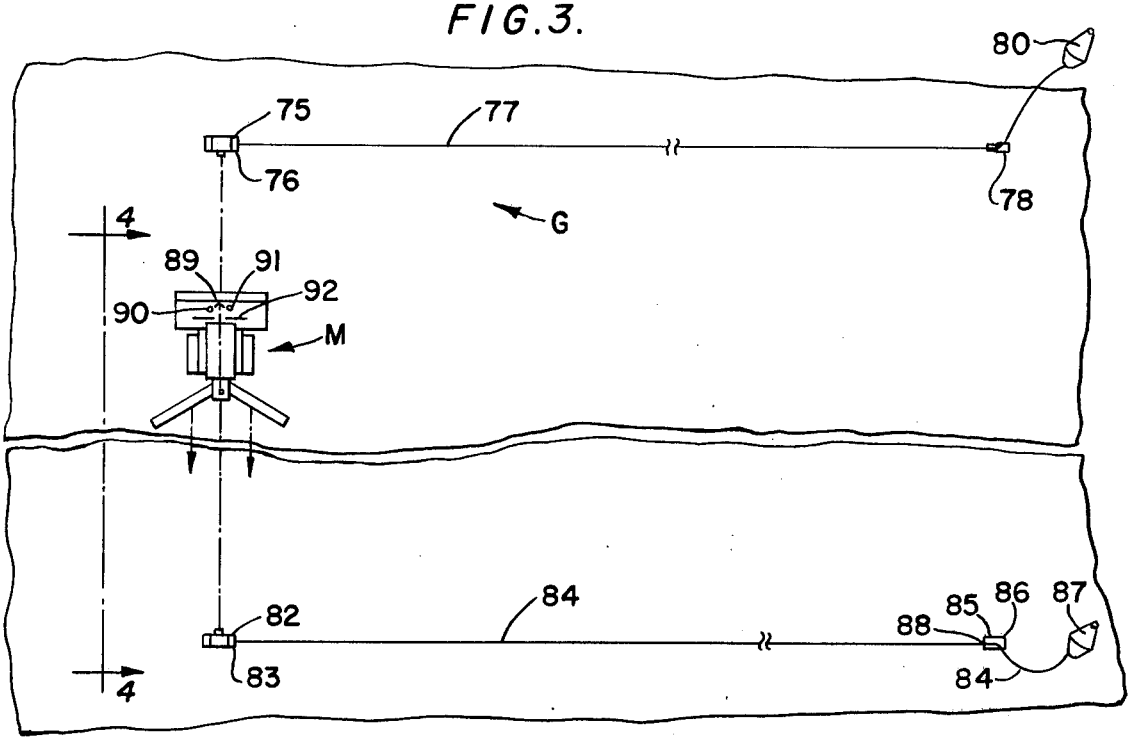
FIG. 3 is a schematic view, with portions broken away, of the guidance system used with the invention.
Figure 4:
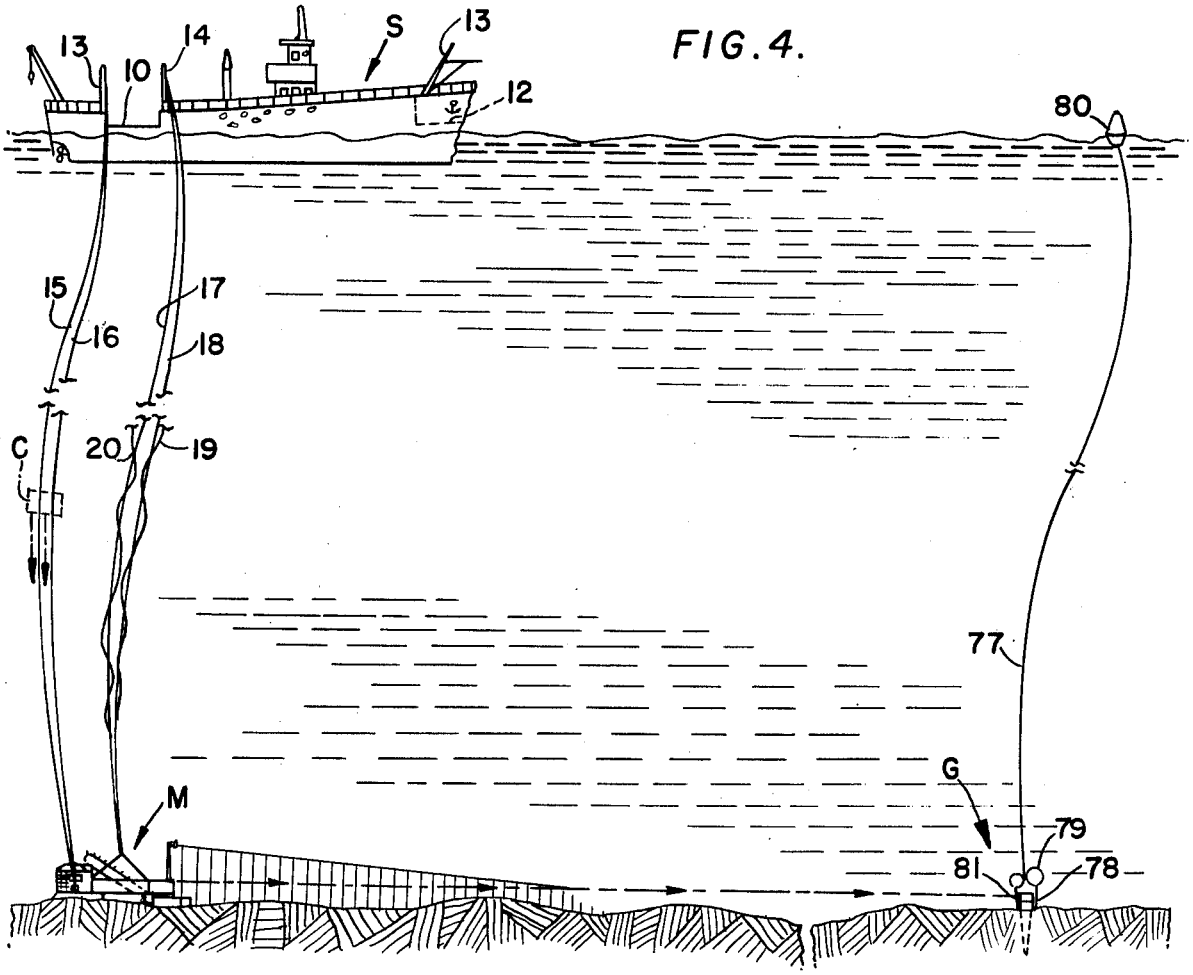
FIG. 4 is a schematic view in elevation of a portion of the apparatus in accordance with the invention, showing a support ship on the surface of the body of water and a mining machine supported and controlled therefrom on the floor of the body of water.

The guidance system G for guiding movement of the mining machines M on the floor of the body of water is seen best in FIGS. 1, 3 and 4, and for each machine M comprises a first sonar device 75 mounted on a skid type holder 76 and connected to a cable 77 which extends along the floor of the body of water a distance of from approximately one kilometer to about ten kilometers, or any other suitable or desired distance, to a cable holder 78 anchored to the floor of the body of water, and including a cable footage counter 79 through which the cable 77 extends to a buoy 80 at the surface of the body of water. The holder 78 also includes a sonar device 81. A substantially identical arrangement comprising a sonar device 82 on a skid type holder 83 is connected with a cable 84 which extends to a cable holder 85, including a cable footage counting device 86, and the cable extends from the holder to a buoy 87 at the surface of the body of water. A sonar device 88 is also provided on the holder 85.

The sonar devices and holders are positioned similarly to the placement shown in FIG. 3, such that the skid devices and sonar devices 75 and 82 are spaced apart approximately 10 to 40 kilometers, and the cables 77 and 84 extend approximately parallel to one another.

In use, once the sonar devices and cables have been positioned as shown in FIG. 3, a mining machine M is lowered to the floor of the body of water and is positioned adjacent one of the sonar devices 75 or 82, depending upon the direction of current, and as seen in FIG. 3, for example, a signal from sonar device 82 is received by a pickup unit 89 on the machine M and including a pair of side sensors 90 and 91 disposed behind an apertured plate 92, whereby once operation of the machine M is initiated, it senses the sonar signal from sonar device 82 and travels in a straight line toward it, thus harvesting mineral nodules over a substantially straight and well defined path between the sonar devices 75 and 82. Once the mining machine M has traversed the distance between the sonar devices 75 and 82, the cables 77 and 84 are drawn through the anchoring devices 78 and 85, pulling the skids 76 and 83 along the floor of the body of water to reposition the sonar devices 75 and 82. The reading on the cable footage readout units indicates or provides an accurate means of determining the repositioning of the machine M, and accordingly, when the machine is brought back and positioned adjacent sonar device 75 for another traverse of the distance between the sonar devices, there is reasonable assurance of mining the mineral nodules from substantially the entire area of the ocean floor bounded by the sonar devices and cables.

Each of the mining machines M preferably has a size such that the sweep arms thereof are capable of mining the mineral nodules from an area or strip approximately 35 meters wide as the machine travels along the ocean floor, and in combination, three of the units arranged in side-by-side or wedge-shaped relationship, or any other desired pattern, are capable of mining or harvesting the nodules from a strip or area about 100 meters wide. Moreover, with the unique and simple self-propelled and remote controlled mining machines of the invention, with the separable nodule containing crates and unique free floating lift means of the invention, three such units can efficiently collect the nodules from an area approximately 5 kilometers long per 24 hours, or in other words, up to 100 tons of mineral nodules can be mined per hour with three such units according to the invention. Based on a value of about $400 to $800 per ton, it can be seen that up to $1,000,000 worth of mineral ore or nodules can be mined in a 24 hour period with the present invention.

Also, the use of the independent lift means or inflatable bag of the invention for raising the mined nodules to the surface of the body of water eliminates the large power requirement heretofore necessary to get the mineral nodules from the floor of the body of water to the surface thereof.

The cables 15 and 16 for guiding and lowering the crates C to the mining machines M are controlled by a computer (not shown), and a cable footage readout or counter (also not shown), and by suitable, conventional level sensors (not shown) on the mining machine M, and the speed of travel of the mining machine M is controlled according to combined load of the sweep arms 29 and 30, drag chains 31 and the windrow elevator or conveyor 50. Thus, the forward travel of the machine is dependent upon the load exerted by operation of the nodule gathering means, which drag along the surface of the floor of the body of water, and excessive strain on the machine is thus eliminated. Further, the unique drag scoops or buckets 34 for collecting the nodules and moving them along the floor of the body of water effects sorting of the nodules from extraneous and undesirable materials at the floor of the body of water, and thus eliminates the problem of sorting and power required to get all of these materials to the surface, as is necessary in prior art devices, and the cable anchoring devices may be anchored in the floor by explosive charges or the like, if desired.

The three mining machines used in a preferred embodiment of the invention may be arranged either in a right or left hand wedge or in a goose wedge pattern, depending upon the direction of the ocean current, and the units or machines always travel forward against the ocean current when mining the nodules from the floor of the body of water. This provides a clean area of vision for the television cameras, so that obstructions and the like can be observed and tangling of the cables from the individual mining machines can be prevented. The machines would operate from 200 to 2,000 feet apart on the sweep path, depending upon the depth of the water and the type of current involved. Additionally, the ocean current will carry the rising crates to the aft of the support ship S to an area where the pickup boats P and barges B can recover the crates easily.

As seen in FIG. 1, the pickup boats may have magnetic clamps or pickup means 93 thereon for lifting the crates and lift bags aboard the pickup boats when the split hull pickup boats P have straddled a lift bag 69. Once the lift bag and crate are picked up by a pickup boat P, the bag is deflated and stored in the cover and the cover is closed and latched, and a new gas cartridge or source of pressure is installed in the crate to provide for the next lift. The crate is then conveyed and locked in place on the pickup boat in a storage area, which in a preferred embodiment, holds approximately 24 crates, or in other words, about 480 tons of mineral nodules. Once the pickup boat has its capacity of crates stored thereon, it travels to a barge B, where it dumps the contents of the crates into the barge and then proceeds to the support ship S, where the crates are attached to the guide cables 15 and 16 to be lowered to the machine M for another load of mineral nodules. In a typical embodiment of the invention, six pickup boats P and three barges B would be required to maximize mining of the nodules from the floor of the body of water.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A deep sea mining apparatus for mining mineral nodules on the ocean floor, comprising at least one support ship floating in a body of water, at last one self-propelled nodule mining machine supported from the support ship and resting on the floor of the body of water for movement along the floor, control means connected with the support ship and with the machine for controlling operation of the machine, nodule gathering means carried by the machine for gathering nodules from the ocean floor, nodule collecting crate means carried by the machine for collecting and holding the nodules gathered by the nodule gathering means, said crate means separable from said machine, and lift means connected to the crate means and comprising an inflatable bag carried by the crate means, and means carried by the crate means for inflating the inflatable bag for lifting the crate means to the surface of the body of water when the crate means is filled with said nodules whereby said nodules may be recovered.

2. Apparatus as in claim 1, wherein said support ship floats on the surface of the body of water, and there are three self-propelled mining machines supported and controlled from the support ship, a plurality of cables connected with each mining machine and with the support ship for raising and lowering the mining machine, and including a pair of cables connectable with the nodule collecting crate means to guide and lower an empty crate means to the mining machine.

3. Apparatus as in claim 2, wherein pressure relief means is connected with said inflated bag to maintain a predetermined pressure differential between the interior of the bag and the surrounding body of water to prevent rupture of the bag as the bag and crate rise from the floor of the body of water toward the surface thereof.

4. Apparatus as in claim 3, wherein the mining machine includes a pair of outwardly and forwardly deployed sweep arms engaged with the floor of the body of water, and having a plurality of drag scoops carried thereby for movement along the floor of the body of water angularly toward the mining machine to engage and drag mineral nodules toward the center of the path of advancement of the mining machine to form a windrow of nodules, and conveyor means carried by the mining machine for conveying the nodules from the windrow to the crate means supported on the mining machine.

5. Apparatus as in claim 1, wherein the support ship floats on the surface of the body of water, and there are three mining machines supported and controlled from the support ship, said apparatus further including a plurality of split hull pickup boats on the surface of the body of water for retrieving crates full of nodules which have been lifted to the surface of the body of water, and at least one barge means for storing the mined mineral nodules held in the crate means and collected by the pickup boats.

6. Apparatus as in claim 1, wherein the control means includes a plurality of sonar devices disposed on the floor of the body of water in spaced apart relationship, and including at least a pair of spaced apart sonar devices adjacent one of which the mining machine is initially positioned, and sensing means on the mining machine for sensing the signal from the other sonar device of said pair and operatively connected with motive power means in said mining machine to propel said mining machine in a substantially straight path between said pair of sonar devices from said one sonar device to the other sonar device.

7. Apparatus as in claim 6, wherein means are connected with said pair of sonar devices for moving said sonar devices along the floor of the body of water, whereby said machine may be repositioned adjacent said one sonar device for again traversing the distance from one sonar device to the other sonar device after it has once traversed said distance.

8. Apparatus as in claim 1, wherein said mining machine includes a pair of forwardly and outwardly deployed sweep arms disposed on the floor of the body of water, said sweep arms each including a drag chain and a plurality of drag scoops carried by the drag chain for movement along the floor of the body of water to engage and convey mineral nodules toward the center of the path of movement of the mining machine, said drag scoops each including a plurality of downwardly projecting, spaced apart teeth which enable small particles, such as sand, silt, mud and the like, to pass therebetween, but which are spaced such that the mineral nodules of a predetermined size are retained thereby for movement along the floor of the body of water to a position in the path of advancement of the machine.

9. Apparatus as in claim 8, wherein a conveyor means is carried by the machine substantially at the center thereof for engaging and conveying the nodules dragged by the scoops into the path of advancement of the machine upwardly into the crate carried by the machine.

10. A deep sea mining apparatus for mining mineral nodules on the ocean floor, comprising at least one support ship floating on the body of water; a plurality of remote controlled, self-propelled nodule mining machines supported by and controlled from said support ship, said machines resting on the floor of the body of water for movement therealong, control means connected with the machines for effecting movement thereof in substantially straight, parallel paths along the floor, said control means comprising a plurality of spaced apart sonar devices mounted on skid devices located on the floor of the body of water, said skid devices being connected by cables to a cable anchoring device and thence to buoy means located on the surface of the water, said floor mounted sonar devices controlling movement of the mining machine via a sonar device mounted on the mining machine, said machines positioned in predetermined spaced relationship to one another to effect efficient and thorough mining of the nodules along a substantially straight path having a width approximately as great as the combined width of the paths of all of the machines, and such that each machine is out of the path of silt and the like stirred up by the other machines.

11. Apparatus as in claim 10. wherein said control means includes means connected with said sonar devices for repositioning said sonar devices when a given area of the floor of the body of water has been covered by said mining machines, whereby said mining machines may be repositioned relative to the repositioned sonar devices to mine another area of the floor of the body of water.

12. Apparatus as in claim 11, further including cable and footage counter means carried by said cable anchoring means for indicating the amount the cables and thus the sonar devices have been moved when they are repositioned, whereby accurate regulation of the positioning of the mining machines is achieved.

13. Apparatus as in claim 12, wherein said control means includes television cameras carried by the mining machine for enabling the path of advancement of the machine to be observed, whereby obstructions and the like may be detected, and said machine controlled to avoid mishaps and the like.

14. Apparatus as in claim 13, wherein said mining machines include nodule collecting and holding crate means releasably carried by the machine, sensing means on the machine to sense when the crate means are full of nodules, crate holding means connected with the crate means holding the crate means on the machine and operative in response to the sensing means to release the crate means when the crate means is full, and lift means carried by the crate means to lift the crate means to the surface of the body of water when it has been released from the mining machine.

15. Apparatus as in claim 14, wherein said lift means comprises an inflatable lift bag carried by the crate means, and means on the crate means for inflating the lift bag in response to a signal from a timer device carried by the crate means.

16. A method of conveying to the surface and recovering mineral nodules mined on the floor of a body of water, comprising placing a mining machine on the floor of the body of water and causing said machine to move along the floor of the body of water, gathering mineral nodules from the floor of the body of water with said machine incident to movement of the machine along the floor, placing said nodules in a crate removably carried by the machine, stopping movement of said machine when said crate is full and separating said crate from the machine, thereafter inflating a buoyant means carried by the crate and floating the crate to the surface, recovering the nodules from the crate, and returning the crate to the machine at the floor of the body of water to be refilled with nodules.

* * * * *